US005226266A

United States Patent [19]

Cernuto

[11] Patent Number: 5,226,266

[45] Date of Patent: Jul. 13, 1993

[54] NEWSSTAND ON WHEELS

[76] Inventor: Jeffrey Cernuto, 7243 Lockmont Dr., Charlotte, N.C. 28212

[21] Appl. No.: 788,274

[22] Filed: Nov. 5, 1991

[51] Int. Cl.[5] ..... E04H 1/12

[52] U.S. Cl. ..... 52/143; 52/79.1; 211/128; 211/55

[58] Field of Search ..... 52/142, 143 R, 27, 79.1; 211/128, 55; 312/249.8, 249.13, 3

[56] References Cited

U.S. PATENT DOCUMENTS 3,909,995 10/1975 Bainter et al. ..... 52/79.1
4,765,492 8/1988 Howard et al. ..... 211/55
4,801,023 1/1989 Ecclestone ..... 211/128

FOREIGN PATENT DOCUMENTS 0282892 9/1988 European Pat. Off. ..... 52/143

*Primary Examiner*—Carl D. Friedman
*Assistant Examiner*—Wynn Wood

[57] ABSTRACT

An outdoor newsstand is mounted on wheels to be easily moved into and out of a business position. The newsstand has supports for removable shelves and magazine racks, and the shelves can be easily rearranged for the display of a variety of merchandise. Weatherproof panels partially enclose the newsstand. The panels can be leased for advertising space.

1 Claim, 6 Drawing Sheets

NEWSSTAND ON WHEELS

FIELD OF THE INVENTION

This invention relates to outdoor newsstands of the type having a plurality of racks for the display of newspapers, magazines, and other items for sale to sidewalk pedestrians.

BACKGROUND OF THE INVENTION

Newsstands are common on the sidewalks of New York and some other large cities. The typical sidewalk newsstand is fixed in place and has fixed shelves for displaying merchandise. They provide a convenient place for pedestrians to purchase newspapers, magazines, etc. However, most cities have an ordinance prohibiting fixed structures on the sidewalks, and their pedestrians are denied the convenience of having an opportunity to select reading material from a sidewalk newsstand and, instead, have to take the time to go into a store for the same purpose.

The prior art sidewalk newsstands that are in use are generally satisfactory for their intended purpose of providing convenient shopping for pedestrians, but there are disadvantages for the owners and operators of the newsstands. One disadvantage of many prior art outdoor newsstands that are fixed in place is that they are located in cities having ordinances requiring the newsstands to be taken down and removed when they are not doing business. Another disadvantage is that most prior art outdoor newsstands are vulnerable to vandalism when not staffed, as when the operator has to observe the call of nature.

A structural disadvantage of the prior art outdoor newsstand is that the fixed shelves are arranged to display specific items for sale, such as newspapers and magazines, and can not be readily rearranged to support seasonal or different types of merchandise, such as flowers, cannisters of nuts, cigarettes, pretzels, etc.

SUMMARY OF THE INVENTION

The newsstand of this invention is designed for attractiveness, durability, adaptability, and efficiency in displaying and marketing a variety of different products at different times, including, for example, printed materials, cigarettes, and edibles such as candies, pretzels, nuts, and the like.

The adaptable newsstand of the present invention is of lightweight construction and supported on wheels. A removable handlebar fits into lugs at the ends of the newsstand to pull or push the stand from either end. The newsstand may be easily moved by one person. Thus, the stand may be temporarily stored, when not in use, in a safe and convenient location, such as a city parking garage. Then, it may be moved for business to a busy sidewalk and, at the end of the business day, the stand may be easily returned to safe storage.

The adaptable newsstand comprises a lightweight angle iron frame that supports lightweight weatherproof panels of foam board that enclose one end and the rear of the stand. The panels provide ideal space that can be leased to display advertisements of others. The roof of the stand is covered with waterproof material and a waterproof curtain encloses the front and open end of the stand in inclement weather.

Adjustable shelves extend across the front of the stand and replaceable magazine racks are supported for convenient access inside and outside the stand. Shelter for the operator is provided behind the front shelves. A door at the rear of the stand provides access to the shelter.

DETAILED DESCRIPTION OF THE INVENTION

Figure 3:
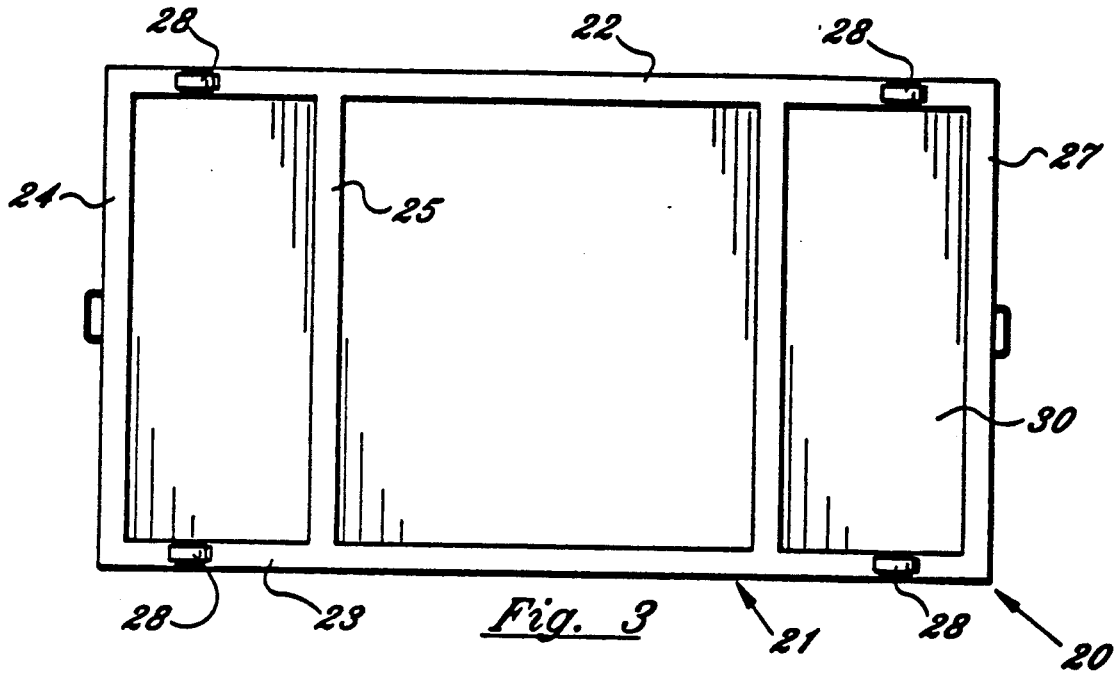
FIG. 3 is an inverse plan view of the adaptable newsstand shown in FIG. 2.
Figure 3A:
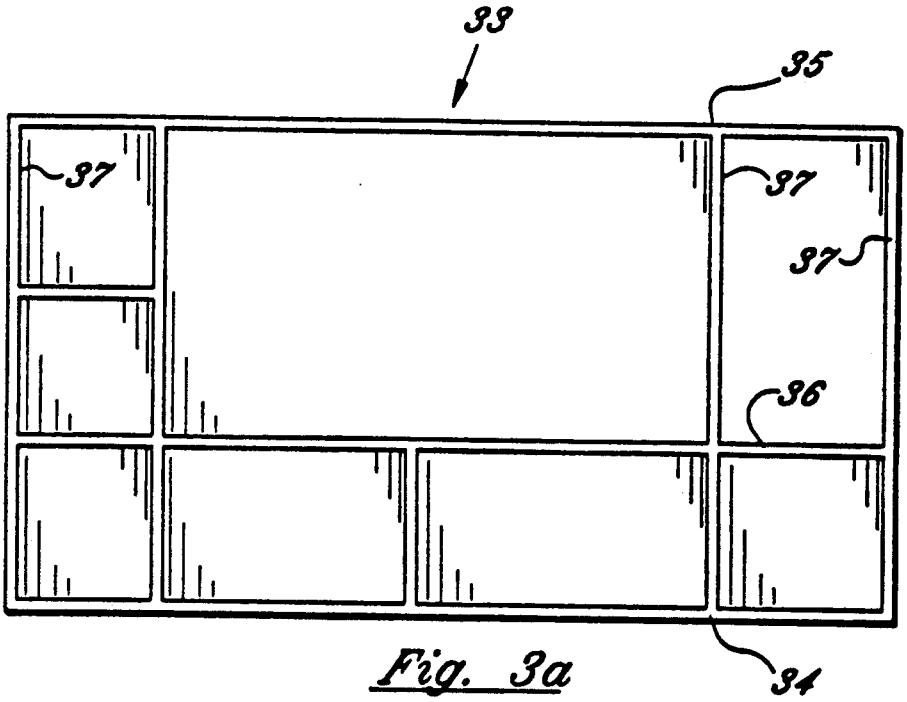
FIG. 3A is an inverse plan view of the top or roof of the adaptable newsstand.

The adaptable newsstand, or stand, is broadly indicated at 20 in the drawings. The stand 20 comprises a rectangular frame broadly indicated at 21 and including longitudinal side pieces 22 and 23 at the rear and front of the stand and longitudinally spaced transverse pieces 24, 25, 26, and 27 extending between the side pieces 22 and 23 (FIG. 3). The chassis is preferably made of metal such as angle iron and is journaled on wheels 28. The frame 21 supports a floor 30, also preferably made from metal with a non-slip upper surface 31, and a plurality of upstanding frame members extending upwardly from the floor 30 to a rectangular canopy frame 33 of canopy 33A. The canopy frame 33 (FIG. 3A) is made in a rectangular configuration with longitudinally extending frame members 34 and 35 at the front and rear of the canopy, respectively. A third longitudinal canopy frame member 36 is spaced inwardly from the front canopy frame member 34 and is intersected by four transverse canopy frame members, each indicated at 37.

Figure 1:
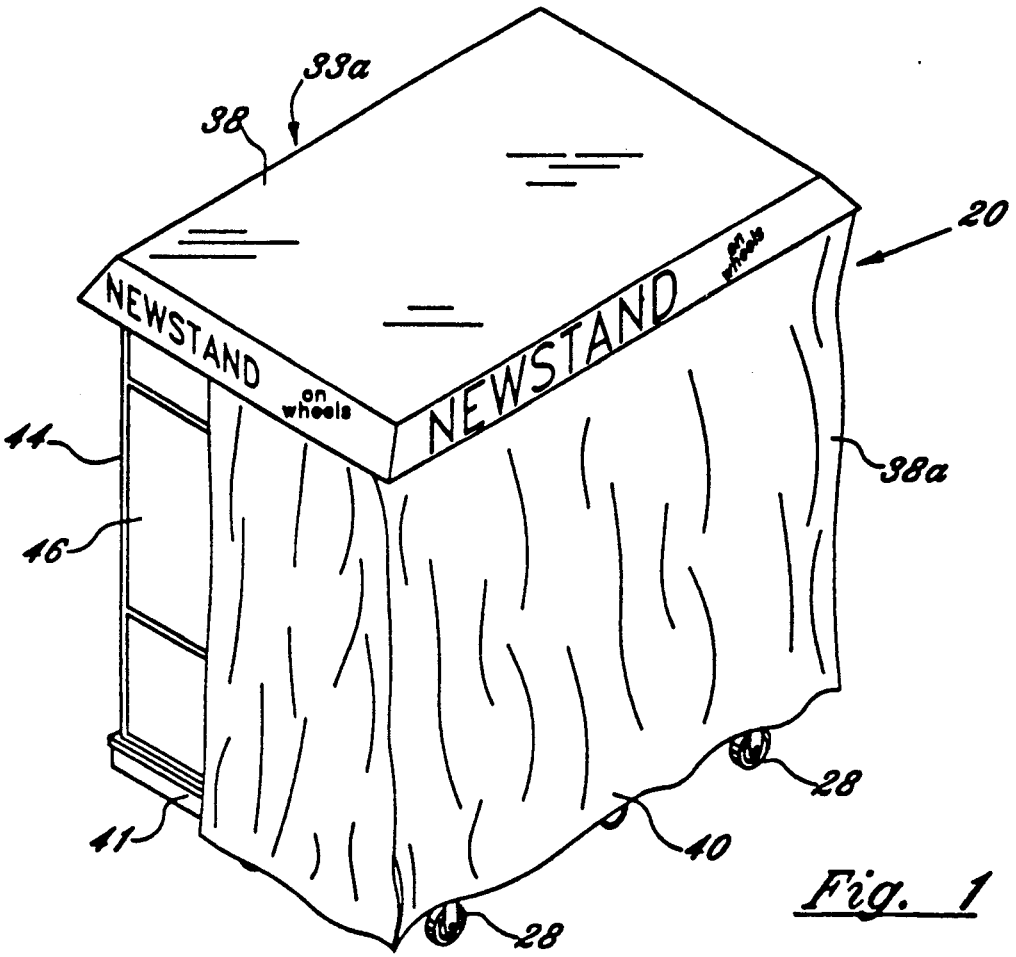
FIG. 1 is a perspective view of the adaptable newsstand enclosed for storage.
Figure 2:
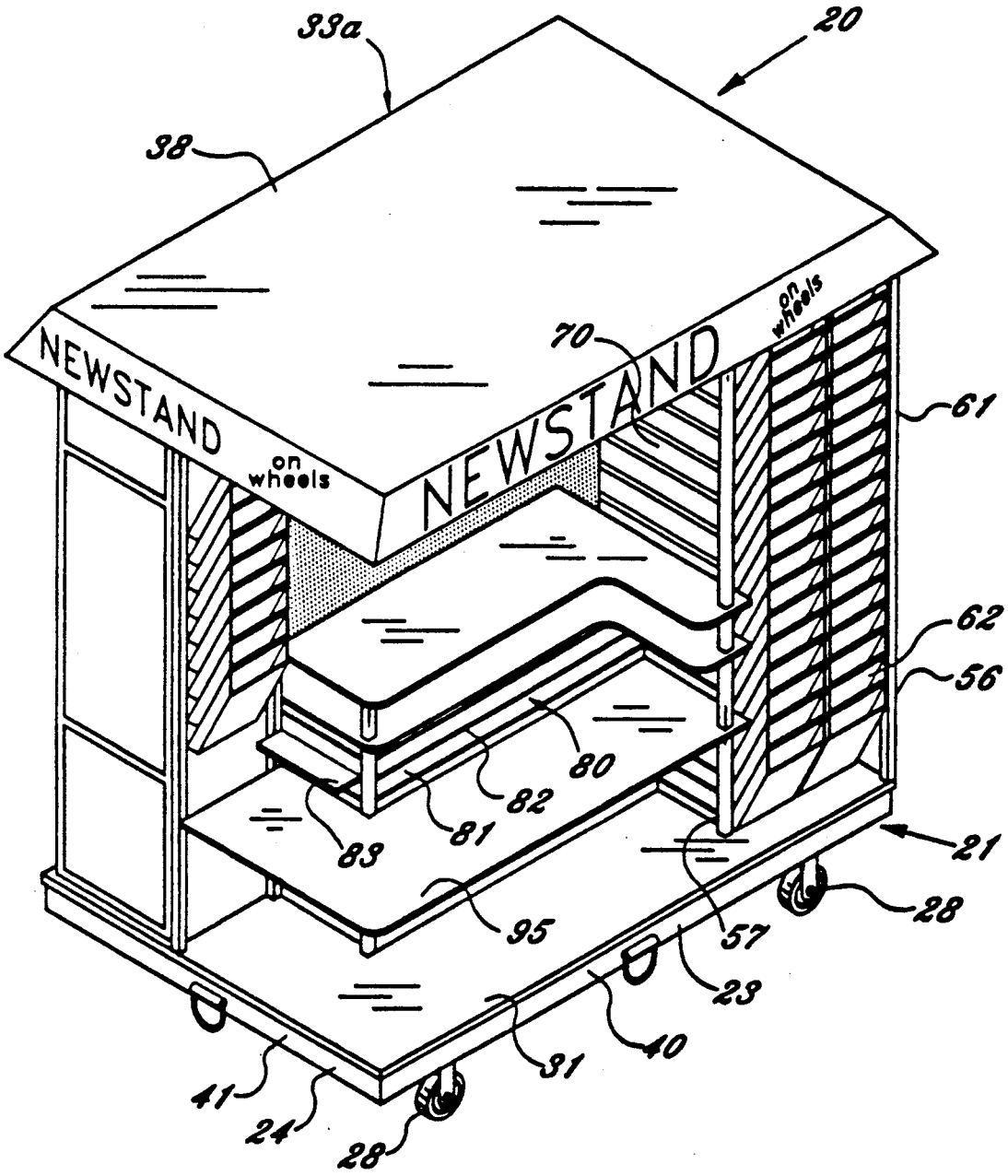
FIG. 2 is a perspective view similar to FIG. 1 but showing the adaptable newsstand opened for use.

The canopy 33A is completed by a flexible waterproof covering 38, such as canvas or the like, extending in a horizontal plane across the newsstand and downwardly at an angle across the front and ends of the canopy frame (FIGS. 1 and 2).

As shown in FIG. 1, the front 40 and open end 41 of the stand 20 is enclosed for protection in inclement weather and for storage by a sheet of canvas or other waterproof material 38A extending downwardly from the canopy 33A. The rear 42 and the end 43 of the newsstand are enclosed by rigid waterproof panels preferably made from weatherproof and lightweight foam board or the like and supported by the frame members extending upwardly from the floor 30 to the canopy frame 33.

Figure 5:
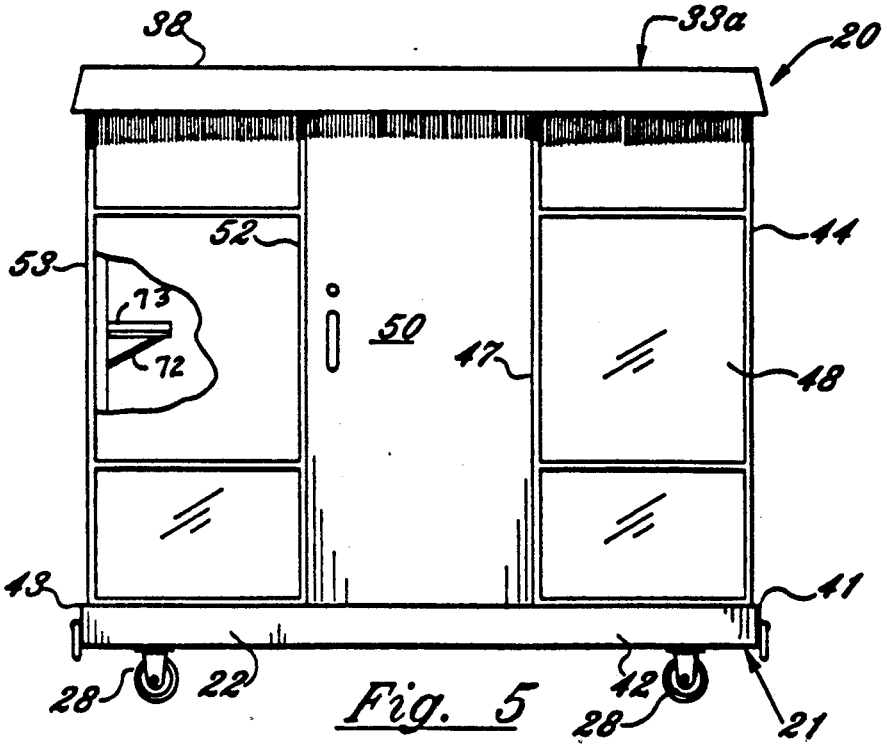
FIG. 5 is a rear view of the adaptable newsstand shown in FIG. 2 with the rear door closed.
Figure 4:
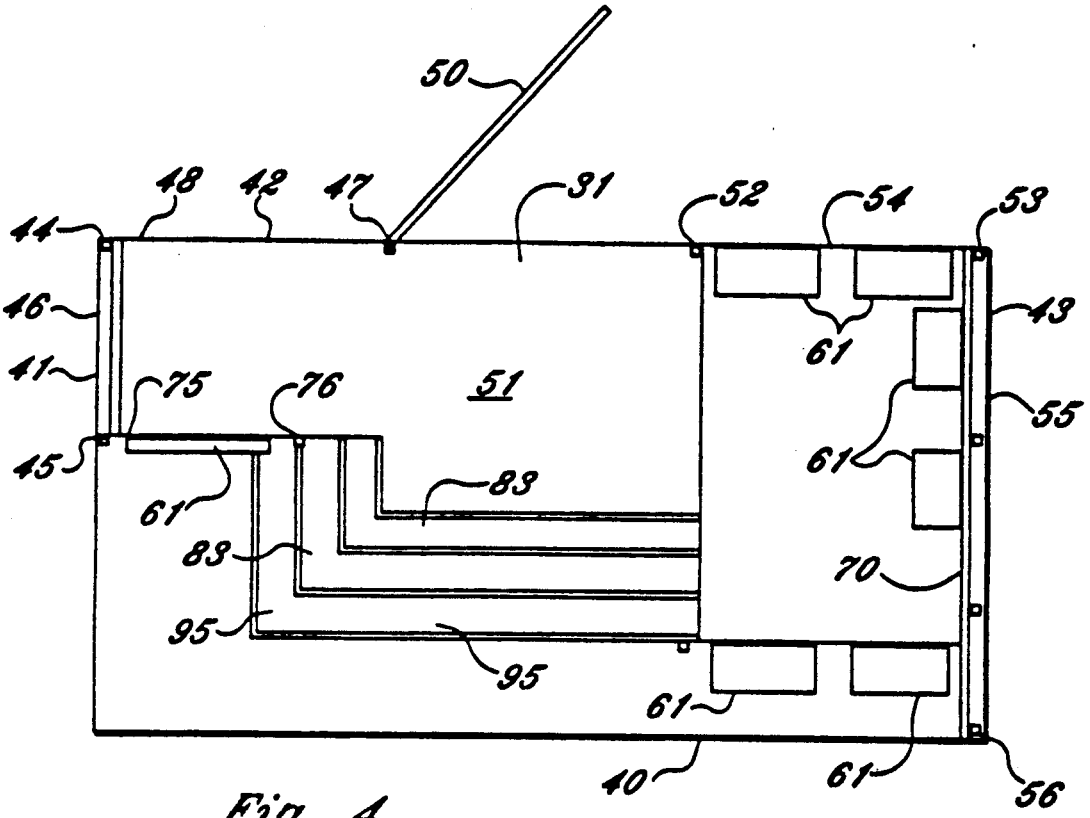
FIG. 4 is a sectional plan view of the newsstand with the rear door open.
Figure 6:
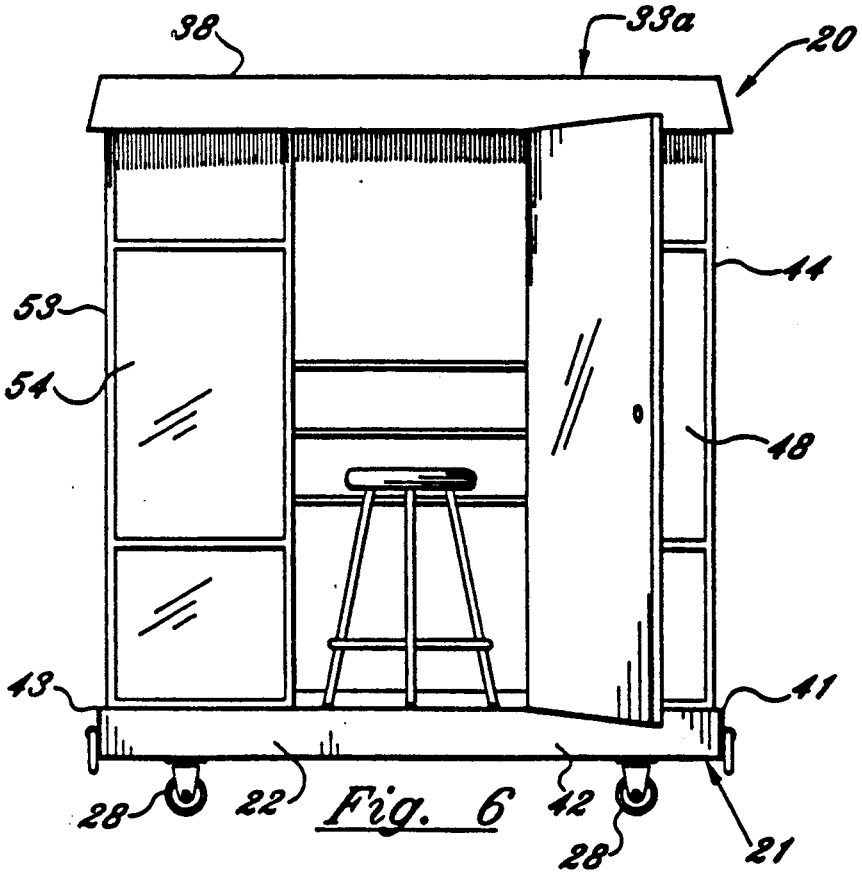
FIG. 6 is a view similar to FIG. 5 but with the rear door open.
Figure 7:
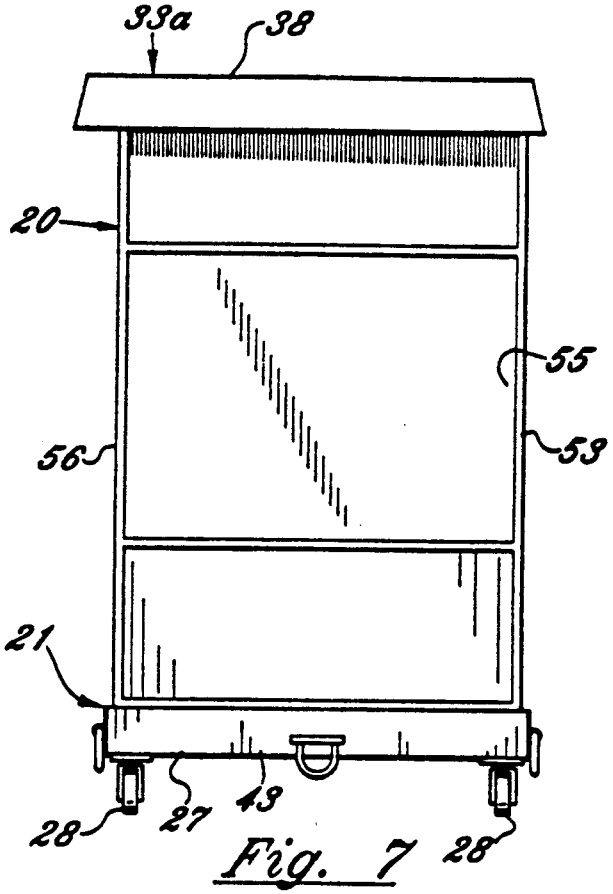
FIG. 7 is an end view of the newsstand looking at the right end of FIG. 2.
Figure 8:
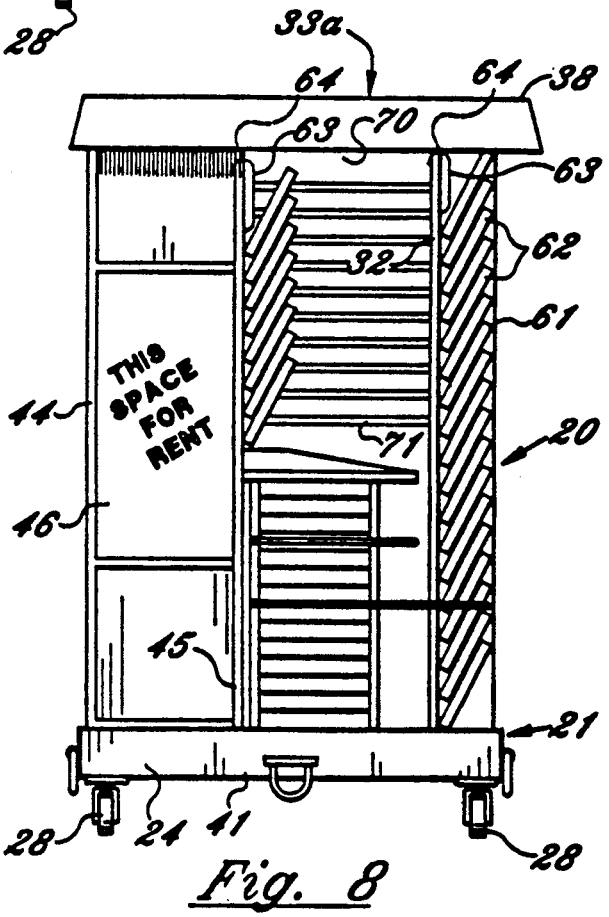
FIG. 8 is an end view of the newsstand looking at the left end of FIG. 2.

More specifically, upstanding frame members 44 and 45 support panel 46 at the end 41 of the newsstand (FIG. 8), and upstanding frame members 44 and 47 support panel 48 at the rear 42 of the newsstand (FIG. 5). Frame member 47 also hingedly supports a door 50 at the rear of the newsstand that is opened to gain access to the sheltered area 51 within the stand 20 (FIG. 4). The door 50 closes against upstanding frame member 52 that, with corner frame member 53, supports panel 54 on the rear of the stand 20. Corner frame member 53 also supports one end of panel 55 that extends across the end 43 of the stand 20, as seen in FIGS. 4 and 7. The front of end panel 55 is supported by corner frame member 56.

The panels 46 and 55 on the ends of the stand and the panels 48 and 54 on the rear of the stand are structured to support advertising copy of third parties, thereby providing additional income to the owner of the adaptable newsstand.

Corner frame member 56 and upstanding frame member 57 on the front of the newsstand support a horizontal rod 60 that in turn supports a removable magazine rack 61 (FIGS. 2 and 4). The rack 61 is formed of metal and comprises a plurality of vertically arranged angularly disposed pockets 62, each shaped to receive a magazine. The rack is removably supported by a hanger 63 reversely curved at its ends as at 64 for attachment to the back of the magazine rack and to the bar 60.

A horizontally slotted panel 70 extends across the inner surface of end panel 55 at the end 43 of the stand. Panel 70 has a plurality of vertically spaced horizontally extending slots 71 extending the width of the stand. The vertically spaced slots 71 are provided for the selective reception of hangers 63 to support removable magazine racks 61 or to support conventional removable angular brackets 72 beneath storage shelves 73 at desired heights (FIG. 5).

Another magazine rack 61 is supported in the manner described on a rod 75 extending inwardly from upright frame member 45 at the end 41 of the newsstand to an upright frame member 76.

Figure 9:
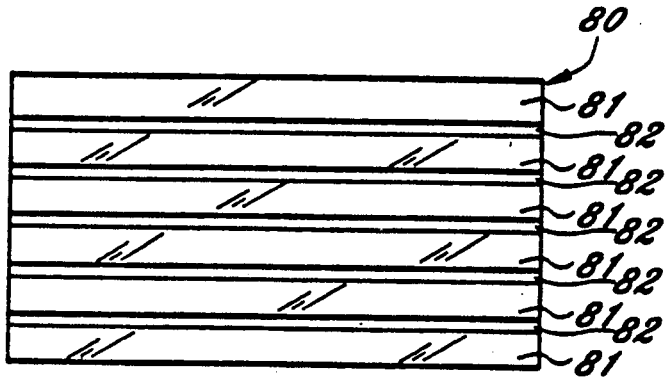
FIG. 9 is a front view of the shelf-supporting panel shown in FIG. 2, with the shelves removed.

A plurality of removable and adjustable shelves 83 extend across the front and one end of the shelter area 51. The removable shelves 83 are supported by a shelf-supporting panel or wall 80 (FIGS. 2 and 9) rising about two and a half feet from the floor 30. The front of the wall 80 comprises a plurality of vertically spaced, horizontally extending narrow mirrors 81. The wall 80 has horizontally extending slots 82 between the mirrors 81.

Figure 10:
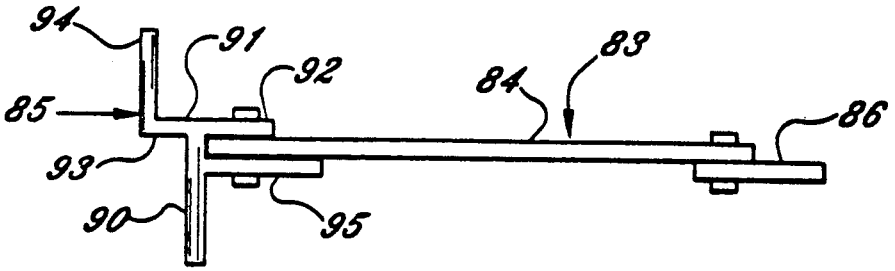
FIG. 10 is an end view of one of the shelves removed from the shelf-support panel shown in FIG. 9.

The typical removable shelf 83, removed from the wall 80 is shown in FIG. 10. The shelf 83 comprises a planar body portion 84, a bracket 85 attached to the rear of the body portion ,and a lip 86 projecting from beneath the body portion and extending along the body portion 84.

The bracket 85 is a metal extrusion or profile comprising a vertical leg 90 topped by a cap 91 extending perpendicularly forwardly and rearwardly from the leg 90. The forward portion 92 of the cap 91 overlies the body portion 84 of the shelf 83 and the rearwardly extending portion 93 of the cap 91 extends beyond the leg 90 and terminates in an upstanding flange 94 extending in parallel off-set relation to the leg 90 in FIG. 10.

The body portion 84 of the shelf 83 is fastened between the forward portion 92 of the cap 91 and a base 95 extending forwardly from the leg 90 in spaced parallel relation beneath the cap 91. Shelves 83 are removably mounted at selected heights on the wall 80 by holding the shelf with the flange 94 extending horizontally to register with a selected slot 82 and then positioning the flange 94 in the selected slot. As seen in FIG. 4, the shelves 83 extend from the front and from one end of the shelter area 51. The projecting lip 86 underlies an adjoining shelf 83 and helps support it.

Figure 11:
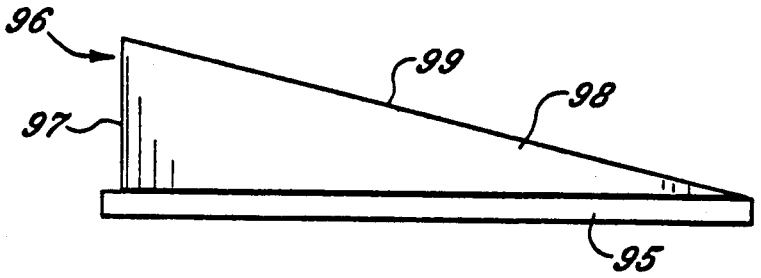
FIG. 11 is an end view of the lower shelf shown in FIG. 2 supporting a removable auxiliary shelf.
Figure 12:
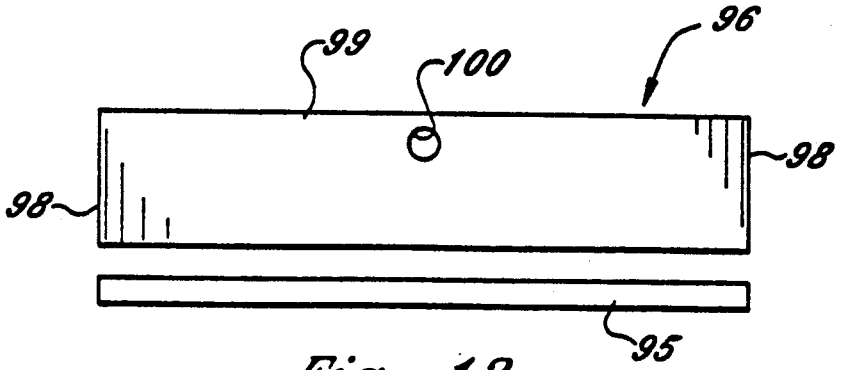
FIG. 12 is an exploded front view of the lower shelf and the removable auxiliary shelf shown in FIG. 11.

A fixed shelf 95 is wider than the removable shelves 83 and extends beyond the shelves 83, as seen in FIGS. 2 and 4. Referring to FIGS. 11 and 12, an auxiliary shelf 96 is provided to rest on the shelf 95 when a sloping shelf surface is desired for display purposes. The auxiliary shelf comprises a rectangular rear wall 97, end walls 98 sloping forwardly from the rear wall, and a top wall 99 fastened to the end walls 98. The top wall 99 has a finger hole 100 to serve as a convenient grip for installing and removing the empty auxiliary shelf 96 from the fixed shelf 95.

There is thus provided an outdoor newsstand that is structured for maximum marketing advantage. It is mobile, in conformance with most city ordinances; the shelving is both readily removable and adjustable to accomodate different types of merchandise; the weatherproof panels are structured to support advertising; and shelter is provided for both the merchandise and the operator.

Although specific terms have been used in describing the invention, they have been used in a generic and descriptive sense only, and not for the purpose of limitation.

I claim:

1. An outdoor newsstand comprising first and second ends 41, 43, a wheeled frame 21, a canopy overlying said wheeled frame, rear weatherproof panels 48, 54 at the rear 42 of said newsstand extending upwardly from said wheeled frame to said canopy, said rear weatherproof panels separated by a door 50, side weatherproof panels 46, 55 at said first and second ends of said newsstand, said side weatherproof panels adjoining said rear weatherproof panels and extending upwardly from said first and second ends of said wheeled frame to said canopy, a second of said side weatherproof panels 55 at said second end 43 of said newsstand enclosing said second end of said newsstand, said first end 41 of said newsstand being only partially enclosed by a first of said side weatherproof panels 46, the newsstand having a sheltered area beneath said canopy between said side weatherproof panels and extending forwardly from said rear weatherproof panels, said sheltered area having a plurality of removable shelves and magazine racks, means for removably supporting said removable shelves at selected locations on said newsstand, and means for removably supporting said removable shelves in various configurations whereby the configuration of said removable shelves may be readily changed to display varying types of merchandise.

* * * * *